United States Patent [19]

McLain et al.

[11] 4,140,428

[45] Feb. 20, 1979

[54] TIE ROD SUPPORT FOR MINE

[75] Inventors: Philippe H. McLain, Gilbert; Ross J. Sullivan, Columbia, both of S.C.

[73] Assignee: Shakespeare Company, Columbia, S.C.

[21] Appl. No.: 883,687

[22] Filed: Mar. 6, 1978

[51] Int. Cl.[2] ..... E21D 21/00

[52] U.S. Cl. ..... 405/261; 151/14.5

[58] Field of Search ..... 61/45 B; 151/14.5, 7; 85/63, 73

[56] References Cited

U.S. PATENT DOCUMENTS

| | | | |
|---|---|---|---|
| 3,394,527 | 7/1968 | McLean | 61/45 B X |
| 3,693,359 | 9/1972 | Karara | 61/45 B |
| 3,893,303 | 7/1975 | Rotter | 61/45 B |
| 3,940,941 | 3/1976 | Libert et al. | 61/45 B |

*Primary Examiner*—Jacob Shapiro

*Attorney, Agent, or Firm*—Hamilton, Renner & Kenner

[57] ABSTRACT

A tie rod support having a lightweight rod of fiber reinforced plastic (FRP) material with a tapered sleeve of non-ferrous material mounted on one end. The other end of the rod is adapted to be inserted axially into a hole in a wall or roof of a mine with the sleeve supporting a pressure plate abutting the inner surface of the wall or roof. Frangible cartridges of polyester resin and a catalyst are first inserted in the hole and axial rotation of the rod as it is inserted into the hole ruptures the cartridges and mixes their contents, causing rapid curing of the resin and a bond between the FRP rod and the inner surface of the hole.

11 Claims, 5 Drawing Figures

TIE ROD SUPPORT FOR MINE

BACKGROUND OF THE INVENTION

U.S. Pat. No. 3,941,028 discloses a mine roof expansion anchor which comprises a tension bolt extending through a serrated expansible sleeve within a vertical hole in the roof, the inner end of the bolt being threaded into a tapered plug to wedgably expand the serrated sleeve into frictional contact with the inner surface of the hole. Thus, the bond between the bolt and the wall of the hole relies on mechanical friction and is limited by the length of the sleeve.

U.S. Pat. No. 3,731,791 discloses the concept of first inserting into the mine roof hole frangible cartridges containing unmixed quantities of a synthetic resin and a catalyst for quick curing thereof, and then inserting and axially rotating a steel bolt to rupture the cartridges and quickly mix the contents, thus bonding the bolt to the inner surface of the hole along substantially the entire length of the bolt. While this system provides good reinforcing of the mine roof, the steel rods are usually about ⅞" in diameter and up to six feet in length, so that they are heavy and difficult to handle, especially in close and confined spaces. Moreover, there is danger of sparking and causing methane gas explosions during insertion of the steel rod.

Further, such steel rods are dangerous to workers and damaging to mining equipment during the final stage of the mining process when coal pillars are being removed, as the rods are thrown about during the rotary clawing action of the equipment.

SUMMARY OF THE INVENTION

The present invention overcomes the foregoing deficiencies by providing a lightweight fiber reinforced rod of synthetic resin having one end mounted in a tapered, preferably non-ferrous fitting for engaging a pressure plate abutting the inner surface of a mine wall or roof, and the other end of the rod is adapted upon insertion and rotation in a hole in the wall to rupture frangible cartridges therein and mix their contents to bond the rod to the wall.

An object of the invention is to provide an improved lightweight tie rod support which eliminates the danger of sparking during installation and damage to equipment during removal.

Another object is to provide a tie rod of plastic material having an improved non-ferrous fitting attached to one end for supporting a pressure plate abutting a mine roof.

A further object is to provide a novel non-ferrous fitting for the end of the tie rod which greatly increases the tensile strength of the rod when installed.

These and other objects are accomplished by the improvements comprising the present invention, a preferred embodiment of which, exemplary of the best known mode of practicing the invention, is shown in the accompanying drawings and described in the following specification. Various modifications and changes in details of construction are comprehended within the scope of the appended claims.

DESCRIPTION OF A PREFERRED EMBODIMENT

The improved rod indicated at 10 is preferably about ½" in diameter and 2 to 4 feet long, depending upon the depth of the hole in which it is to be inserted. The material of the rod is fiber reinforced plastic material, for example, a pultruded fiber reinforced polyester or epoxy resin. The upper end of the rod is preferably provided with transverse projections which may be the projecting ends of a key 11 secured therein.

Figure 1:
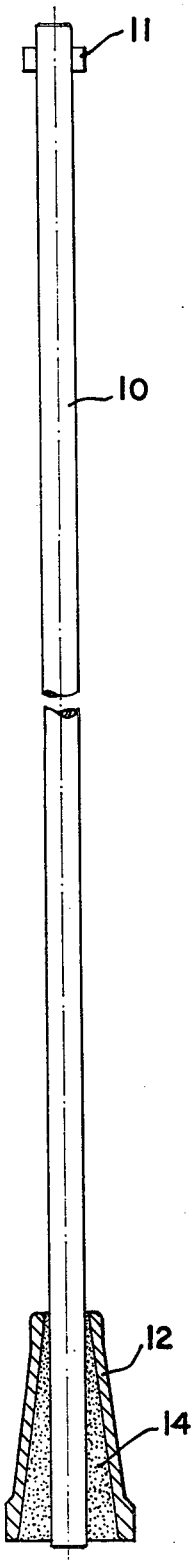
FIG. 1 is a side elevation, partly in section, of the improved tie rod and fitting.
Figure 2:
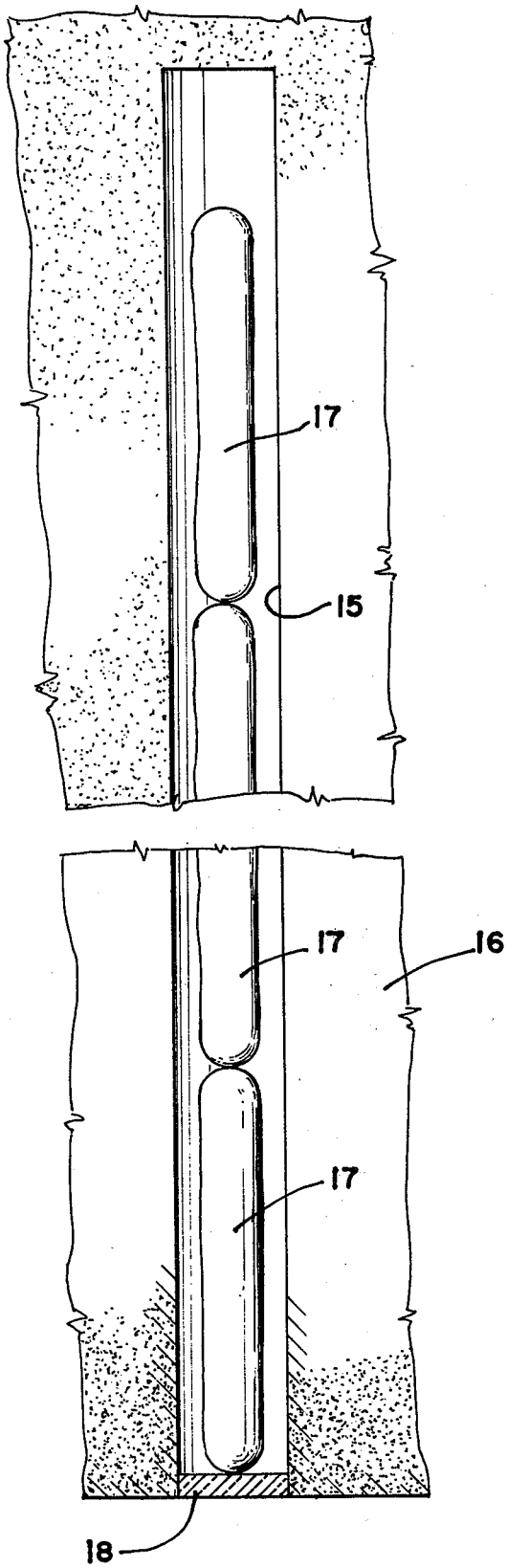
FIG. 2 is a sectional view of a portion of a mine roof, showing cartridges inserted in a vertical hole therein.
Figure 3:
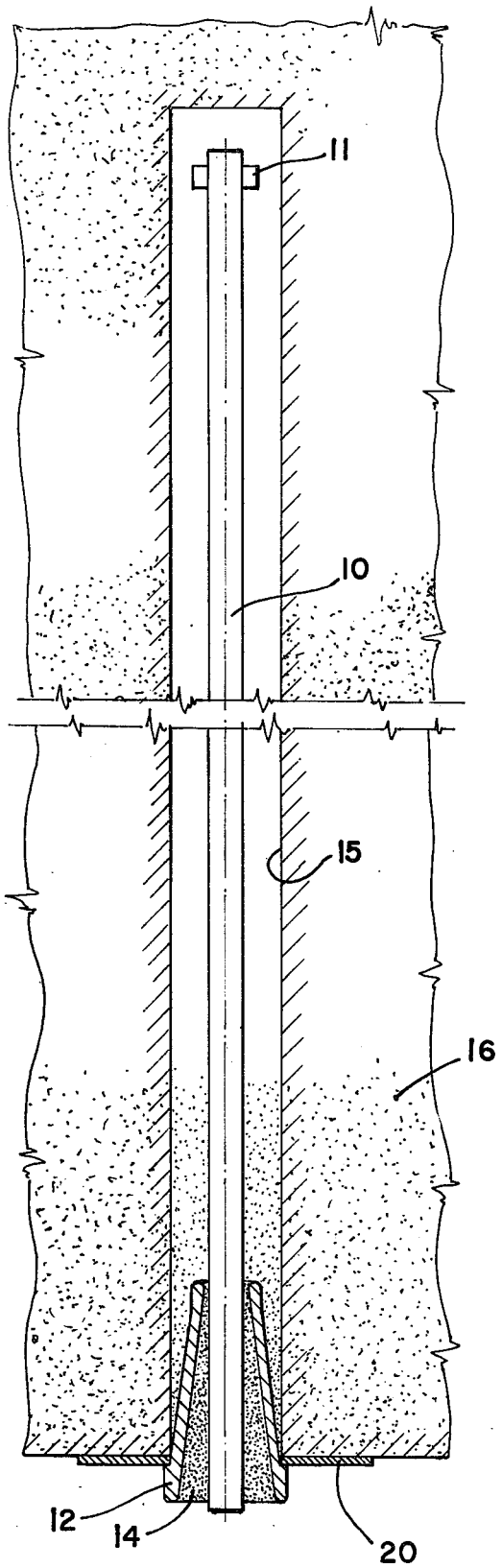
FIG. 3 is a similar view showing the tie rod bonded in place in the hole.
Figure 5:
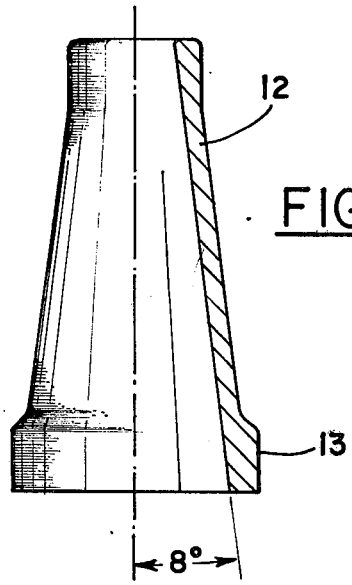
FIG. 5 is a partial sectional view as on line 5—5 of FIG. 4.
Figure 4:
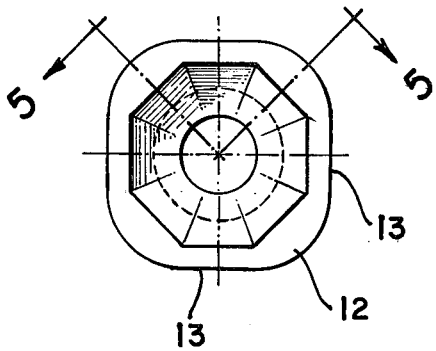
FIG. 4 is an enlarged end view of the fitting.

The lower end of rod 10 extends axially through a tapered anchor sleeve 12 which may be of aluminum, preferably cast aluminum. The sleeve 12 is positioned on the rod 10 by filling the space between the rod and sleeve with an epoxy resin 14 which bonds to the rod. Preferably, a mold release agent is first applied to the inner surface of the sleeve to inhibit substantial bonding of the epoxy resin thereto, for a reason to be described. The larger end of the sleeve is flat-sided around its exterior as indicated at 13 so as to be engageable by the socket of a rotating power tool and the rod may extend slightly below the bottom of the sleeve to bear against the socket. Preferably, the inner surface of the sleeve is polygonal as shown in FIG. 4, and its inner sides are inclined to its axis at an angle of about 8°.

When the rod is to be inserted into a hole 15 in a mine side wall or roof wall 16, one or more elongated cartridges 17 are first inserted end-to-end in the hole and the bottom of the hole may be temporarily closed by inserting a frangible expansible plug 18 which may be expansible polystyrene. The hole 15 may be of the order of 1" in diameter. The cartridges 17 preferably have an outer frangible plastic casing containing a composition based on an unsaturated polyester resin and a catalyst composition longitudinally disposed within the casing in direct contact with the resin. The construction and composition of the cartridges 17 is described in detail in U.S. Pat. No. 3,731,791 and is incorporated by reference herein. Suffice it to say that when the resin and catalyst are mixed a very rapid reaction occurs and the composition begins to cure and form a bond to adjacent surfaces in less than one minute. The composition bonds readily with the plastic material of rod 10 and with the inner surface of the hole.

After the cartridges 17 are positioned in the hole, the outer end of the rod 10 is inserted into the hole 15 through a pressure plate 20 for abutting the wall surface around the hole, and the socket of a rotating power tool is engaged with the flat-sided larger end of the fitting 12. The polygonal socket of the fitting prevents relative rotation of the fitting on the resin mass 14. As the rotating key 11 tears open the cartridges and rapidly mixes the resin and catalyst therein, the resin fills the space between the rod and the inner surface of the hole and creates a bond therebetween in less than one minute.

The inherent tensile strength of the rod 10 is greatly increased when installed due to the design and construction of the anchor sleeve assembly. Because the inner surface of the sleeve is not substantially bonded to the epoxy resin mass 14, when the rod 10 is pre-loaded as a result of forcing the sleeve into the pressure plate 20, a slight amount of longitudinal creepage occurs between the sleeve and the rod and this adds a substantial compressive force between the sleeve and the epoxy resin mass 14 instead of a straight shearing action. For this purpose, the 8° angle of inclination of the interior surface of the sleeve 12 has been found to be about optimum, because a lesser angle causes compression of the rod and failure in shear, whereas a greater angle tends to strip the epoxy off the rod.

Actual tests have shown that the tensile strength of the improved rod and anchor sleeve combination is more than three times that of a rod of the same size and material bonded to a fitting and depending solely upon the shear strength of the bond.

Because of increased tensile strength of the reinforced plastic rod and tapered sleeve combination a rod of ½" diameter can be used weighing about 12% of the weight of a conventional ⅞" diameter steel rod of the same length. Thus, the improved rod is much easier to handle and install, and there is no possibility of sparking of the rod or the tapered anchor sleeve. Further, when mine pillars containing the improved rods are subsequently removed there is little danger to workers or damage to equipment because of the lightness in weight and the characteristics of the plastic rods.

What is claimed is:

1. A tie rod support for a wall in a mine, comprising an elongated rod of fiber reinforced plastic material adapted for axial insertion in an elongated hole in said mine wall, means on one end of said rod for rupturing plastic cartridges in said hole, and a tapered anchor sleeve non-rotatively mounted on the other end of said rod by an epoxy resin bonded to said rod and non-rotatively engaging said sleeve, for supporting a pressure plate against the surface of said mine wall.

2. A tie rod support as described in claim 1, wherein the means on one end of the rod for rupturing plastic cartridges is a transverse projection.

3. A tie rod support as described in claim 1, wherein the tapered anchor sleeve is non-ferrous material.

4. A tie rod support as described in claim 3, wherein the inner surface of the anchor sleeve is inclined to its axis at an angle of about 8° and the larger end of the sleeve is substantially flush with the end of said rod.

5. A tie rod support as described in claim 1, wherein the fiber reinforced plastic material of the rod is a polyester resin, and the anchor sleeve is aluminum.

6. A tie rod support as described in claim 5, wherein the anchor sleeve is mounted on said rod by an epoxy resin mass bonded to said rod and non-rotatively engaging said sleeve.

7. A tie rod support as described in claim 6, wherein the inner surface of the anchor sleeve is inclined to its axis at an angle of about 8° and the larger end of the sleeve is substantially flush with the end of said rod.

8. A tie rod support as described in claim 1, wherein said anchor sleeve has exterior flat surfaces for engaging the socket of a rotary tool.

9. A tie rod support as described in claim 8, wherein said anchor sleeve is mounted on said rod by an epoxy resin mass bonded to said rod and non-rotatively engaging said sleeve.

10. A tie rod support as described in claim 9, wherein the inner surface of the anchor sleeve is inclined to its axis at an angle of about 8° and the larger end of the sleeve is substantially flush with the end of the rod.

11. A tie rod support as described in claim 10, wherein the fiber reinforced plastic material of the rod is a polyester resin, and the anchor sleeve is aluminum.

* * * * *